US011384759B2

(12) United States Patent
Bhatia et al.

(10) Patent No.: US 11,384,759 B2
(45) Date of Patent: Jul. 12, 2022

(54) VAPOR INJECTION DOUBLE REED VALVE PLATE

(71) Applicant: Hanon Systems, Daejeon (KR)

(72) Inventors: Kanwal Bhatia, Canton, MI (US); Rod Callahan, Novi, MI (US); Kyung Jae Lee, Daejeon (KR); Steven J. Koester, Toledo, OH (US); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 2 days.

(21) Appl. No.: 17/101,756

(22) Filed: Nov. 23, 2020

(65) Prior Publication Data

US 2021/0285445 A1 Sep. 16, 2021

Related U.S. Application Data

(60) Provisional application No. 62/987,638, filed on Mar. 10, 2020.

(51) Int. Cl.
*F04C 18/02* (2006.01)
*F04C 29/04* (2006.01)
(Continued)

(52) U.S. Cl.
CPC ..... *F04C 18/0215* (2013.01); *F04C 18/0261* (2013.01); *F04C 29/042* (2013.01);
(Continued)

(58) Field of Classification Search
CPC .... F04C 18/0215–0292; F04C 29/0007; F04C 29/0014; F04C 29/042;
(Continued)

(56) References Cited

U.S. PATENT DOCUMENTS 2,064,754 A * 12/1936 Ivens ..... F04B 39/1073 137/454.4
4,257,458 A * 3/1981 Kondo ..... F16K 15/16 137/512.15
(Continued)

FOREIGN PATENT DOCUMENTS

EP 3572671 A1 * 11/2019 ..... F04C 28/24
JP H11230063 A 8/1999
(Continued)

*Primary Examiner* — Mark A Laurenzi
*Assistant Examiner* — Xiaoting Hu
(74) *Attorney, Agent, or Firm* — Shumaker, Loop & Kendrick, LLP; James D. Miller

(57) ABSTRACT

A valve assembly forms a check valve for a scroll compressor including a fixed scroll having a pair of injection ports fluidly coupled to a compression mechanism. The valve assembly includes a valve body having a pair of flow paths with each of the flow paths fluidly coupled to a corresponding one of the injection ports. An injection plate has a pair of injection holes. A reed structure is disposed between the injection plate and the valve body with the reed structure including a pair of reeds. Each of the reeds is configured to selectively provide fluid communication between a corresponding one of the injection holes and a corresponding one of the injection ports. A valve gasket is disposed between the reed structure and the valve body and includes a pair of flaps with each of the flaps configured to selectively contact a corresponding one of the reeds.

19 Claims, 7 Drawing Sheets

(51) Int. Cl.
*F04C 29/12* (2006.01)
*F04C 28/26* (2006.01)

(52) U.S. Cl.
CPC ..... *F04C 28/26* (2013.01); *F04C 29/128* (2013.01); *F04C 2210/26* (2013.01); *F04C 2240/30* (2013.01); *F04C 2270/58* (2013.01)

(58) Field of Classification Search
CPC .. F04C 29/126; F04C 29/128; F04C 2270/58; F04C 18/0261
See application file for complete search history.

(56) References Cited

U.S. PATENT DOCUMENTS

| | | | | | |
|---|---|---|---|---|---|
| 5,073,146 | A * | 12/1991 | Beck | ..... | F04B 39/1066 417/571 |
| 5,885,064 | A * | 3/1999 | McCoy | ..... | F04B 39/1086 417/569 |
| 2017/0030471 | A1 | 2/2017 | Rosa | | |
| 2020/0063737 | A1* | 2/2020 | Nakai | ..... | F04C 29/0007 |

FOREIGN PATENT DOCUMENTS

| | | | | | |
|---|---|---|---|---|---|
| JP | 2015129475 | A * | 7/2015 | ..... | F04C 28/24 |
| JP | 2015129475 | A | 7/2015 | | |
| JP | 2018053827 | A | 4/2018 | | |
| WO | 2018003525 | A1 | 1/2018 | | |

* cited by examiner

VAPOR INJECTION DOUBLE REED VALVE PLATE

CROSS-REFERENCE TO RELATED APPLICATION

This patent application claims priority to U.S. Provisional Patent Application Ser. No. 62/987,638, filed on Mar. 10, 2020, the entire disclosure of which is hereby incorporated herein by reference.

FIELD OF THE INVENTION

The invention relates to a check valve assembly for preventing back flow and distributing fluid evenly to a scroll compressor with minimal flow losses.

BACKGROUND OF THE INVENTION

As is commonly known, vehicles typically include a heating, ventilating, and air conditioning (HVAC) system. In certain applications, a scroll compressor is employed for compressing a refrigerant circulated through a refrigerant circuit of the HVAC system. More specifically, such refrigerant circuits may be configured for use with a vapor injection scroll compressor that utilizes two different inputs of the refrigerant at different pressures and/or temperatures for optimizing the capacity of the vapor injection scroll compressor in comparison to single input scroll compressors. This is typically achieved by returning a portion of the refrigerant back towards the vapor injection scroll compressor after initially exiting the compression chambers of the vapor injection scroll compressor. Depending on the configuration of the refrigerant circuit, the returned refrigerant may be expanded via a corresponding expansion element, subcooled via a corresponding heat exchanger, or separated via a cyclone separator or the like, as well as any combinations thereof, prior to reentry back into the vapor injection scroll compressor to ensure that the returned refrigerant has the desired characteristics for the given application.

Generally, scroll compressors include a fixed scroll that remains stationary and an orbiting scroll that is nested relative to the fixed scroll and configured to orbit relative to the fixed scroll. The orbiting motion of the orbiting scroll, as well as the similar spiral shape of each of the fixed scroll and the orbiting scroll, continuously forms corresponding pairs of substantially symmetric compression chambers between the fixed scroll and the orbiting scroll. Each pair of the compression chambers is typically symmetric about a centralized discharge port of the vapor injection scroll compressor. Refrigerant typically enters each of the compression chambers via one or more inlet ports formed adjacent a radially outmost portion of the fixed scroll and then the orbiting motion of the orbiting scroll relative to the fixed scroll results in each of the compression chambers progressively decreasing in volume such that the refrigerant disposed within each of the compression chambers progressively increases in pressure as the refrigerant approaches the radially central discharge port.

The vapor injection scroll compressor is distinguished from traditional scroll compressors by injecting the returned refrigerant into each of the symmetrically formed compression chambers at a corresponding intermediate position disposed radially between the outwardly disposed inlet ports and the centrally disposed discharge port of the fixed scroll. Due to the presence of the pairs of the symmetric compression chambers between the cooperating scrolls, it is beneficial to introduce the returned refrigerant at two different injection openings that are similarly substantially symmetrically disposed relative to the centrally disposed discharge port such that each of the paired compression chambers receives a flow of the returned refrigerant at similar positions within the compression process. The injected refrigerant accordingly enters each of the compression chambers at a position corresponding to a region of the fixed scroll repeatedly subjected to a pressure of the radially inwardly flowing refrigerant that is generally intermediate the suction pressure formed at the inlet ports and the discharge pressure formed at the discharge port of the fixed scroll. The injected refrigerant originates from an injection chamber of the vapor injection scroll compressor configured to receive the returned refrigerant therein prior to reintroduction back into the compression chambers.

Additionally, the continuous orbiting of the orbiting scroll relative to the fixed scroll results in each of the injection openings formed in the fixed scroll being subjected to a variable pressure during each orbit of the orbiting scroll based on whether a corresponding portion of the orbiting scroll has passed by the corresponding injection opening with respect to each orbit cycle. It is therefore necessary for each of the injection openings of the fixed scroll to be associated with a corresponding check valve for ensuring that the returned refrigerant is injected into the corresponding compression chamber in a single flow direction. Specifically, the check valves ensure that the returned refrigerant can enter the corresponding compression chamber only when the refrigerant already disposed within the compression chamber is at a relatively low pressure that is lower than the pressure of the injected refrigerant. The check valve further prevents an occurrence wherein any compressed refrigerant at a relatively high pressure greater than that of the injected refrigerant flows in reverse (backflows) through the injection opening, through the injection chamber, and towards any components disposed upstream of the injection chamber with respect to the returned refrigerant, such as the aforementioned cyclone separator.

Such check valves may be provided as ball valves that are biased by a spring or the like to a closed position until the injected refrigerant pressure exceeds the pressure of the refrigerant present within the corresponding compression chamber. However, it has been discovered that the use of such ball valves may result in an undesirable pressure drop in the injected refrigerant that reduces the output capacity of the vapor injection scroll compressor. Other shortcomings of such ball valves may be the need for multiple components such that manufacturing complexity is increased, a need for increased axial packaging space for accommodating the motion of the ball relative to the spring, and an inconsistency of the distribution of the injected refrigerant to each of the pair of the injection openings.

Such a check valve may also be provided as a reed valve having a flexible metallic reed that flexes in response to a pressure differential thereacross. However, such reed valves are traditionally provided to include repeated metal to metal contact, which greatly reduces the durability of such reed valves and also introduces a concern of noise, vibration, and harshness (NVH) that can potentially be experienced by a passenger of a vehicle.

It would therefore be desirable to provide an improved and durable check valve mechanism to minimize back flow of the refrigerant, more evenly distribute the refrigerant between each of the injection openings when entering the corresponding compression chambers, and prevent an occurrence of NVH during operation thereof.

SUMMARY OF THE INVENTION

Consistent and consonant with the present invention, an improved check valve assembly for use with a vapor injection scroll compressor is disclosed.

According to an embodiment of the present invention, a valve assembly for a scroll compressor including a fixed scroll having a first injection port fluidly coupled to a compression mechanism of the scroll compressor is disclosed. The valve assembly includes a valve body having a first flow path formed therethrough with the first flow path fluidly coupled to the first injection port. An injection plate has a first injection hole formed therethrough. A reed structure is disposed between the injection plate and the valve body. The reed structure includes a first reed configured to selectively permit a fluid to flow through the first injection hole towards the first flow path for entry into the compression mechanism through the first injection port.

According to another embodiment of the present invention, a valve assembly forms a check valve for a scroll compressor including a fixed scroll having a pair of injection ports fluidly coupled to a compression mechanism of the scroll compressor. The valve assembly includes a valve body having a pair of flow paths formed therethrough with each of the flow paths fluidly coupled to a corresponding one of the injection ports. An injection plate has a pair of injection holes formed therethrough. A reed structure is disposed between the injection plate and the valve body with the reed structure including a pair of reeds. Each of the reeds is configured to selectively provide fluid communication between a corresponding one of the injection holes and a corresponding one of the injection ports. A valve gasket is disposed between the reed structure and the valve body and includes a pair of flaps with each of the flaps configured to selectively contact a corresponding one of the reeds.

According to yet another embodiment of the present invention, a vapor injection scroll compressor comprises a compression mechanism formed by the cooperation of a fixed scroll and an orbiting scroll. The compression mechanism is configured to compress a fluid therein. The fixed scroll includes a pair of injection ports formed therethrough with each of the injection ports in fluid communication with the compression mechanism. An injection chamber is configured to receive a portion of the fluid after being compressed within the compression mechanism. A valve assembly includes a reed structure having a pair of reeds. Each of the reeds is configured to selectively provide fluid communication between the injection chamber and a corresponding one of the injection ports.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner.

FIGS. 1-7 illustrate the relevant portions of a vapor injection scroll compressor 1 having an injection valve assembly 20 according to an embodiment of the present invention. As used hereinafter, the vapor injection scroll compressor 1 is referred to as the scroll compressor 1 while the injection valve assembly 20 is referred to as the valve assembly 20. The scroll compressor 1 may be provided as a component of an HVAC system of a motor vehicle, and more particularly, a component for circulating a refrigerant of an associated refrigerant circuit in heat exchange communication with air to be delivered to the passenger compartment of the associated motor vehicle. The refrigerant may also be in heat exchange relationship with additional components of the motor vehicle in need of heat regulation, such as a battery or other electronic components associated with operation of various different systems of the motor vehicle. References to the refrigerant as used hereinafter may refer to a refrigerant when provided solely as a gas or as a mixture of a gas and a liquid. Although the scroll compressor 1 is described as being utilized for a refrigerant of an HVAC system, it should be apparent that the structure disclosed herein may be adapted for use with any fluid in need of compression with respect to any associated fluid system, as desired.

Figure 1:
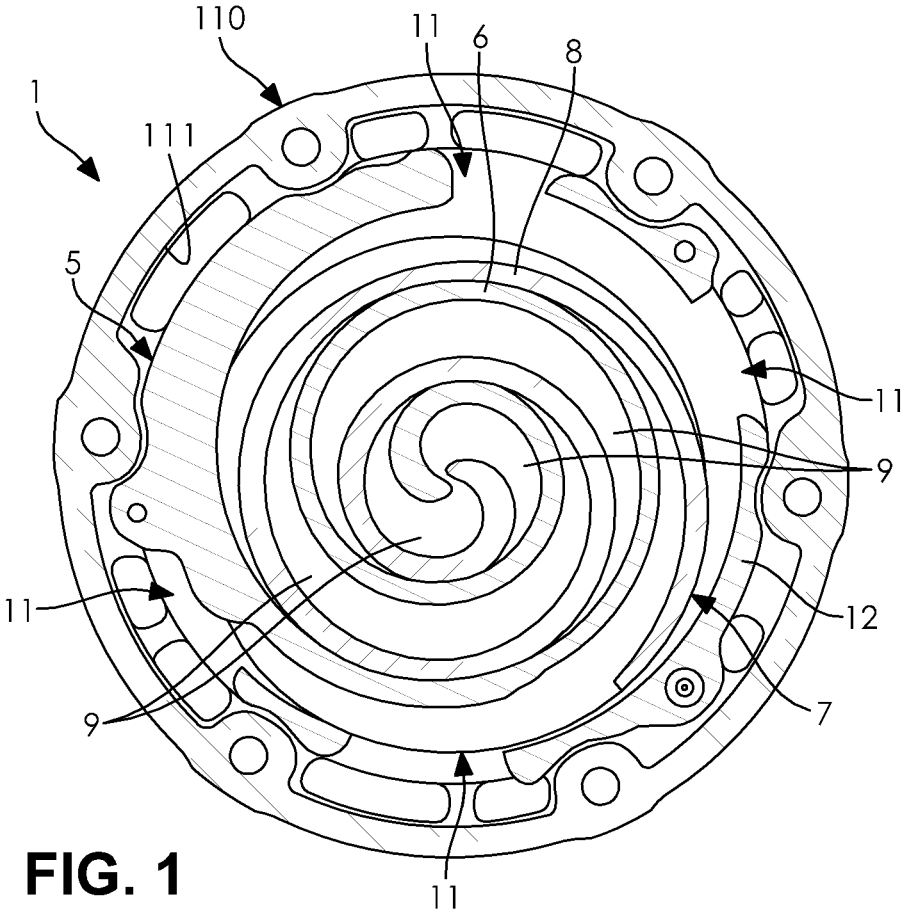
FIG. 1 is a cross-sectional elevational view taken through a compression mechanism of a scroll compressor according to an embodiment of the present invention.

As best shown in cross-section in FIG. 1, the scroll compressor 1 includes a compression mechanism formed by a fixed scroll 5 having an axially extending first spiral structure 6 and an orbiting scroll 7 having an axially extending second spiral structure 8. The second spiral structure 8 extends in an opposing axial direction relative to the first spiral structure 6 with each of the spirals of the second spiral structure 8 nested into each of the spaces formed between adjacent spirals of the first spiral structure 6. The first spiral structure 6 and the second spiral structure 8 are positioned relative to each other to form a plurality of compression chambers 9 therebetween during operation of the compression mechanism of the scroll compressor 1.

The fixed scroll 5 includes at least one inlet opening 11 adjacent a radially outermost portion thereof for introducing the refrigerant into each of the compression chambers 9. In the provided embodiment, the fixed scroll 5 includes a plurality of the inlet openings 11 circumferentially spaced apart from each other in an outer circumferential wall 12 of the fixed scroll 5 with each of the inlet openings 11 provided as a hole, indentation, or other form of passageway allowing for radially inward flow of the refrigerant into one of the compression chambers 9. The refrigerant generally enters the fixed scroll 5 through one of the inlet openings 11 at a relatively low pressure typically referred to as a suction pressure of the scroll compressor 1. The fixed scroll 5 further includes a discharge opening 13 formed at a radial innermost end of the first spiral structure 6 through which the refrigerant exits each of the compression chambers 9 after having been compressed therein. The discharge opening 13 is accordingly located at or adjacent a radial center of the fixed scroll 5. The compressed refrigerant thereby exits the cooperating scrolls 5, 7 at a relatively high pressure that is greater than the relatively low pressure suction pressure, wherein the relatively high pressure is referred to as the discharge pressure of the scroll compressor 1.

The orbiting scroll 7 is configured to orbit relative to the fixed scroll 5 in a manner wherein each of the compression chambers 9 progresses circumferentially and radially inwardly towards the discharge opening 13. A shape and position of each of the compression chambers 9 accordingly changes relative to the fixed shape and position of the fixed scroll 5 during the repeating orbiting motion of the orbiting scroll 7. This motion causes each of the compression chambers 9 to reduce in flow volume as each of the compression chambers 9 approaches the radially inwardly disposed discharge opening 13, thereby causing the previously discussed compression of the refrigerant.

FIG. 1 illustrates the cross-section through the fixed scroll 5 and the orbiting scroll 7 when the compression mechanism is at a position having two pairs of opposing compression chambers 9. Each of the compression chambers 9 forming one of the pairs includes substantially the same shape rotated 180 degrees relative to the other of the paired and opposing compression chambers 9. A first pair of the compression chambers 9 is disposed immediately adjacent a radial center of each of the spiral structures 6, 8 (generally corresponding to the position of the discharge opening 13) while a second pair of the compressions chambers 9 is formed radially outwardly of the first pair of the compression chambers 9 closer to the inlet openings 11.

Figure 2:
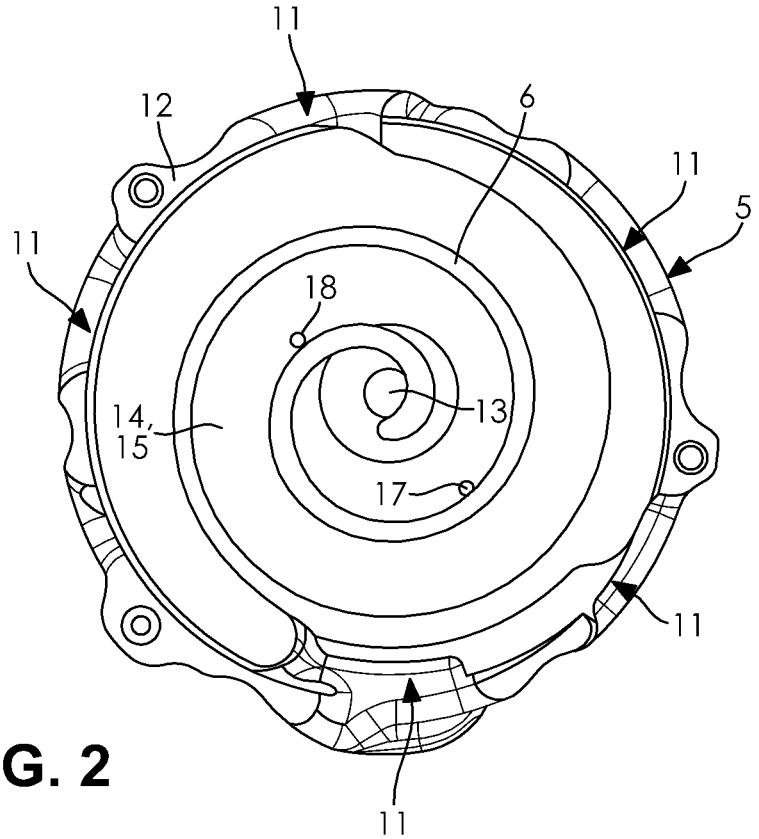
FIG. 2 is an axial end elevational view of a fixed scroll of the compression mechanism of FIG. 1 with the fixed scroll shown in isolation.

The fixed scroll 5 includes an end wall 14 including an inner face 15 and an opposing outer face 16. The inner face 15 faces towards the orbiting scroll 7 with the first spiral structure 6 extending axially from the inner face 15. The outer face 16 faces away from the orbiting scroll 7 and faces towards the previously mentioned valve assembly 20 (shown in FIG. 3). The discharge opening 13, a first injection port 17, and a second injection port 18 are all formed through the end wall 14 from the inner face 15 to the outer face 16 thereof. FIG. 2 shows the inner face 15 of the end wall 14 with the orbiting scroll 7 omitted to better illustrate the positioning of the discharge opening 13 and the injection ports 17, 18 relative to the configuration of the first spiral structure 6.

The first injection port 17 is positioned substantially opposite the second injection port 18 relative to the centrally disposed discharge opening 13, with each of the injection ports 17, 18 also spaced radially at a substantially equal distance from the discharge opening 13. The substantially opposite positioning of the injection ports 17, 18 allows for the first injection port 17 to fluidly communicate with a first one of each of the oppositely paired compression chambers 9 and the second injection port 18 to fluidly communicate with a second one of each of the oppositely paired compression chambers 9. As such, each of the compression chambers 9 progressing radially inwardly towards the discharge opening 13 is able to fluidly communicate with one of the injection ports 17, 18 at a substantially similar radial position relative to the discharge opening 13, which also corresponds to the refrigerant disposed within each of the opposing and paired compression chambers 9 having a similar pressure when fluidly communicating with the corresponding one of the injection ports 17, 18. The pressure of the refrigerant when reaching each of the injection ports 17, 18 may be referred to as an intermediate pressure having a value between the previously described suction pressure and discharge pressure.

Figure 3:
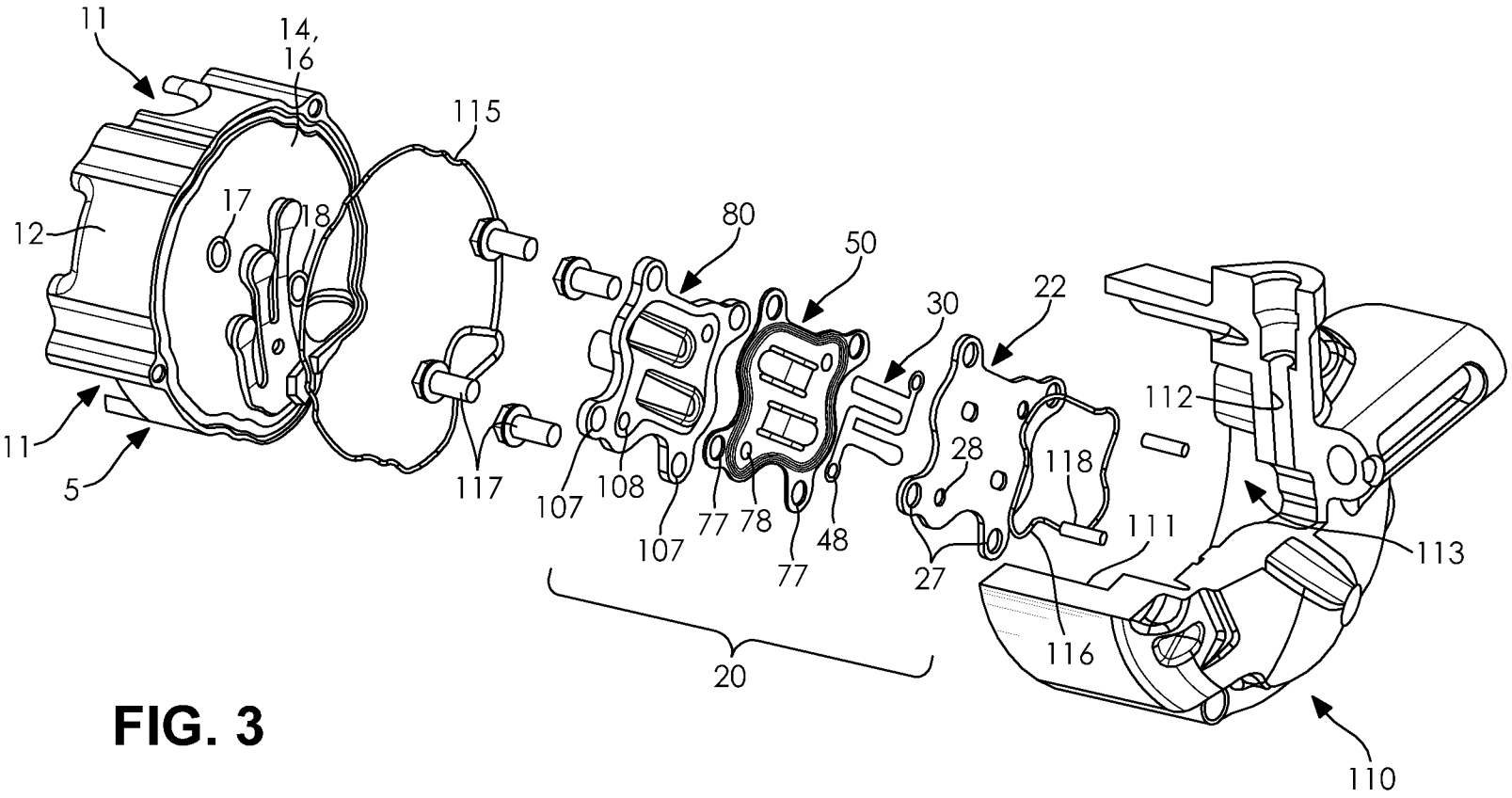
FIG. 3 is an exploded and partial cross-sectional perspective view of the relevant components of the scroll compressor necessary for illustrating an injection valve assembly of the scroll compressor.
Figure 4:
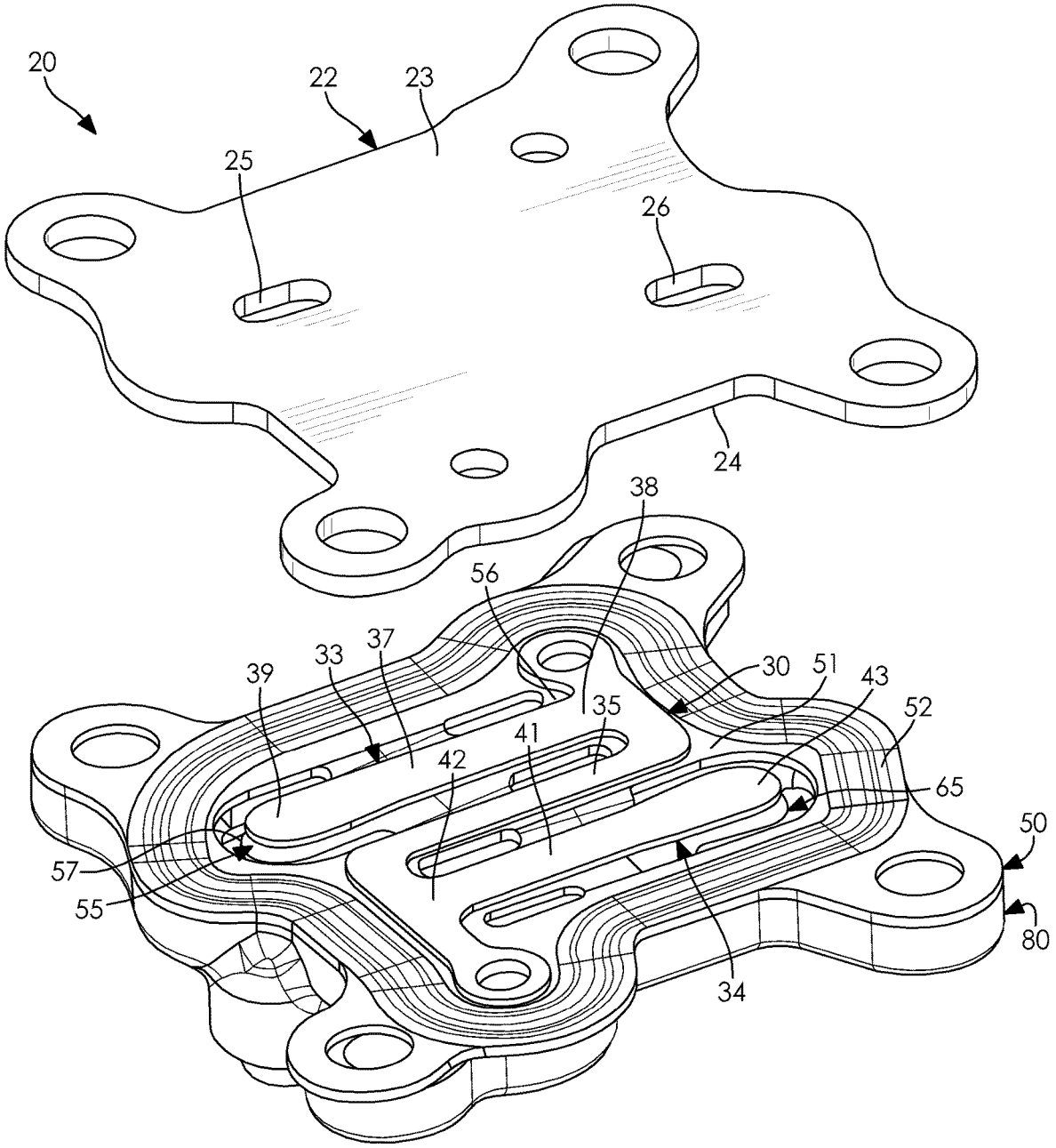
FIG. 4 is a partially exploded perspective view of the injection valve assembly of FIG. 3 with an injection plate thereof separated from a reed structure, a valve gasket, and a valve body thereof.

Referring now to FIG. 3, the components of the scroll compressor 1 relevant to the operation of the valve assembly 20 are shown in exploded view for more easily ascertaining the method of assembly thereof. The orbiting scroll 7 and the components necessary for causing the orbiting motion thereof are omitted, but one skilled in the art should readily appreciate that the method of operation of the valve assembly 20 is apparent from the illustrated perspective in their absence.

A rear housing 110 of the scroll compressor 1 is an open ended and hollow structure configured to mate with a front housing (not shown) of the scroll compressor 1 for enclosing the internal components thereof. The rear housing 110 defines a housing opening 111 configured to receive the fixed scroll 5 and the valve assembly 20 therein. One skilled in the art should appreciate that alternative configurations of the housing components of the scroll compressor 1 may be provided so long as the relevant structures for directing the flow of the refrigerant are maintained as described hereinafter, including the use of additional housing components or the use of housing components having alternatively arranged joints present therebetween. More specifically, any combination of housing components may be utilized so long as the housing opening 111 is provided to receive the fixed scroll 5 and the valve assembly 20 therein in a manner promoting operation of the valve assembly 20 as disclosed hereinafter.

The housing opening 111 is in fluid communication with a refrigerant return passage 112. The refrigerant return passage 112 provides fluid communication between the housing opening 111 and another component (not shown) of the associated refrigerant circuit through which the refrigerant is passed after being initially compressed within the compression mechanism of the scroll compressor 1. For example, the component may be a separator (not shown) disposed downstream of the compression mechanism and upstream of a low pressure side of the scroll compressor 1 with respect to a general direction of flow of the refrigerant through the refrigerant circuit, such as a cyclone separator. The refrigerant return passage 112 is configured to receive a partial flow of the refrigerant after branching away from the refrigerant circuit. The partial flow of the refrigerant may have a pressure between the discharge pressure and the suction pressure and may bypass at least one component of the refrigerant circuit disposed upstream of the low pressure side of the scroll compressor 1. In some instances, the component from which the refrigerant branches back towards the refrigerant return passage 112 may be disposed immediately downstream of the compression mechanism and even from a downstream arranged portion of the scroll compressor 1 itself. One skilled in the art should appreciate that the refrigerant may return to the refrigerant return passage 112 from any component of the refrigerant circuit while remaining within the scope of the present invention so long as the refrigerant has the required characteristics for being injected back into the compression chambers 9 during the compression process occurring within the compression mechanism.

The refrigerant return passage 112 leads to an injection chamber 113 of the rear housing 110. The injection chamber 113 is an open space provided as a portion of the housing opening 111 disposed between the refrigerant return passage 112 and the valve assembly 20. The refrigerant entering the injection chamber 113 may be a gaseous vapor or a combination of a gaseous vapor and a liquid, depending on the circumstances of the returned refrigerant.

A first gasket 115 is disposed between a periphery of the outer face 16 of the fixed scroll 5 and an inner surface of the rear housing 110 defining the housing opening 111 thereof. The fixed scroll 5 is received into the housing opening 111 with the first gasket 115 compressed between the outer face 16 and the inner surface of the rear housing 110 for creating a seal in a manner wherein refrigerant cannot flow around a periphery of the fixed scroll 5 to isolate the injection chamber 113 and the valve assembly 20 from the low pressure side of the scroll compressor 1. The valve assembly 20 is disposed between the outer face 16 and the refrigerant return passage 112 with the outwardly facing surfaces thereof exposed to the refrigerant entering the injection chamber 113 through the refrigerant return passage 112.

The valve assembly 20 includes an injection plate 22, a double reed structure 30, a valve gasket 50, and a valve body 80, wherein the components are disposed in the provided order when progressing from the refrigerant return passage 112 towards the fixed scroll 5. The direction of assembly of the valve assembly 20 as shown by the direction of separation of the components forming the valve assembly 20 in the exploded view of FIG. 3 is hereinafter referred to as an axial direction of the valve assembly 20. The axial direction of the valve assembly 20 also corresponds to the axial direction of each of the constituent components thereof as used hereinafter.

The injection plate 22 includes a substantially planar first major surface 23 and an oppositely arranged and also substantially planar second major surface 24, wherein the major surfaces 23, 24 are arranged parallel to each other and perpendicular to the axial direction of the valve assembly 20. The first major surface 23 faces towards the refrigerant return passage 112 and the second major surface 24 faces towards the reed structure 30 and the valve gasket 50.

The injection plate 22 includes a first injection hole 25 and a spaced apart second injection hole 26. Each of the injection holes 25, 26 extends through the injection plate 22 with respect to the axial direction from the first major surface 23 to the second major surface 24 thereof. A spacing between the injection holes 25, 26 with respect to a direction perpendicular to the axial direction may be substantially similar to or equal to a spacing between the first injection port 17 and the second injection port 18 formed through the fixed scroll 5.

Each of the injection holes 25, 26 is shown as having an elongated perimeter shape with a direction of elongation of each of the injection holes 25, 26 arranged in parallel. The injection holes 25, 26 may otherwise be referred to as injection slots 25, 26 due to the elongated configurations thereof. Each of the injections holes 25, 26 is shown as having an elongate stadium shape, but other rounded and elongate shapes may be utilized such as an elliptical shape, oval shape, rounded rectangular shape, or the like. The elongate shape of each of the injection holes 25, 26 beneficially provides for an increased cross-sectional flow area therethrough in comparison to a purely circular cross-sectional shape, which in turn increases the total force that can be applied by the returned refrigerant through each of the injection holes 25, 26 with respect to a given pressure of the refrigerant. However, other shapes, including the circular shape, may be utilized while still appreciating the remaining beneficial characteristics of the valve assembly 20.

A second gasket 116 is disposed between a periphery of the first major surface 23 and the inner surface of the rear housing 110 defining the housing opening 111. The second gasket 116 provides a seal between the injection plate 22 and the rear housing 110 to prevent refrigerant from bypassing the flow paths formed through the valve assembly 20 and fluidly communicating with the compression chambers 9 of the scrolls 5, 7.

The injection plate 22 is generally rectangular in shape with each of the four corners of the rectangular shape including a fastener opening 27 formed therethrough. The fastener openings 27 are disposed outwardly from a position of the perimeter of the second gasket 116 when sealingly engaging the injection plate 22. As shown in FIG. 3, each of the fastener openings 27 is configured to axially receive a corresponding threaded fastener 117 for coupling and compressing the components of the valve assembly 20 together as explained in greater detail hereinafter. An end of each of the threaded fasteners 117 may be inserted into one of four corresponding threaded openings (not shown) provided in the surface of the rear housing 110 defining the housing opening 111. Alternative coupling methods may also be utilized so long as the components forming the valve assembly 20 are compressed to one another for forming the necessary fluid tight seals therebetween while maintaining the relationships between the components as explained hereinafter.

The injection plate 22 also includes a pair of spaced apart locating openings 28 formed therethrough. Each of the locating openings 28 is configured to receive a corresponding locating feature 118 therethrough when the valve assembly 20 is in the assembled configuration. The locating features 118 may be threaded fasteners, pins, or the like. The use of two of more of the locating openings 28 ensures that the components of the valve assembly 20 do not translate in a direction perpendicular to the axial direction thereof or rotate about an axis arranged parallel to the axial direction thereof. However, other locating features such as cooperating projections and indentations may be present within the components forming the valve assembly 20 while remaining within the scope of the present invention.

The injection plate 22 is formed from a rigid material resistant to deformation when subjected to the pressure applied by the returned refrigerant entering the injection chamber 113. The injection plate 22 may be formed from a metallic material such as aluminum, aluminum alloy, steel, or the like, as desired.

Figure 6:
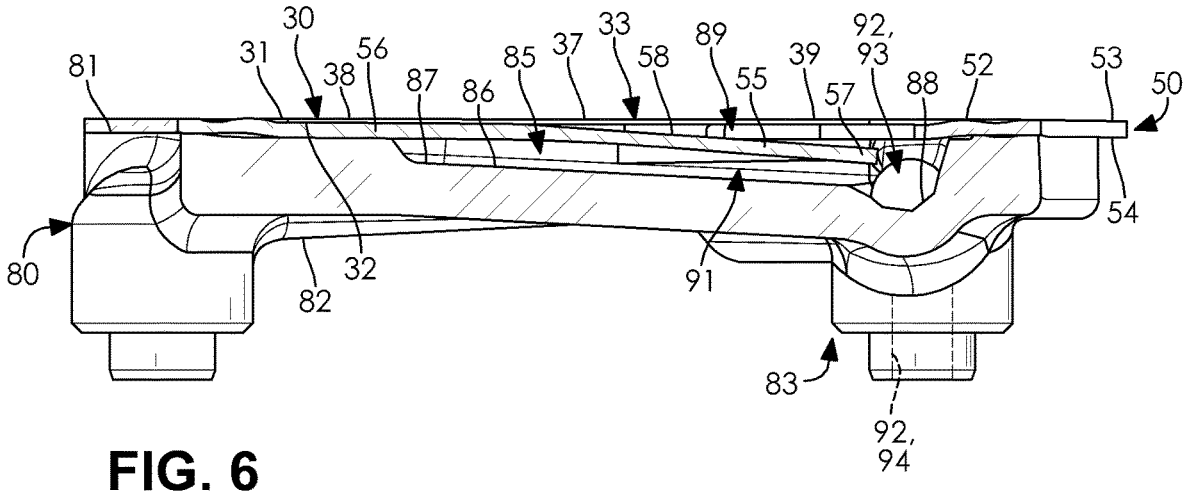
FIG. 6 is a cross-sectional elevational view of the reed structure, the valve gasket, and the valve body as taken from the perspective of section lines 6-6 in FIG. 5.

The double reed structure 30 is a thin and planar plate-like body including a first major surface 31 and an oppositely arranged second major surface 32 (best shown in FIG. 6). The major surfaces 31, 32 are arranged parallel to each other and perpendicular to the axial direction of the valve assembly 20. The first major surface 31 is configured to face towards and engage the second major surface 24 of the injection plate 22 and the second major surface 32 is configured to face towards and engage the valve gasket 50 as explained in greater detail hereinafter.

The double reed structure 30 includes a first reed 33, a second reed 34, and a connecting portion 35. The reeds 33, 34 and the connecting portion 35 are integrally formed as one monolithic structure. The first reed 33 and the second reed 34 normally extend longitudinally away from the connecting portion 35 in opposing parallel directions perpendicular to the axial direction of the valve assembly 20 when the reeds 33, 34 are not flexed during operation of the scroll compressor 1. In the provided embodiment, the reeds 33, 34 and the connecting portion 35 cooperate to have a substantially Z-shaped configuration, but the connecting portion 35 may have any shape or configuration so long as the connecting portion 35 extends between and connects the reeds 33, 34 to form the described unitary structure with the reeds 33, 34 arranged in the illustrated staggered configuration.

The first reed 33 includes an arm 37 extending longitudinally between a pivot portion 38 and an end portion 39. The pivot portion 38 forms an axis about which the remainder of the first reed 33 (including the end portion 39 disposed at a distal end of the arm 37 opposite the pivot portion 38) flexes relative to the stationary connecting portion 35. The end portion 39 is disposed in alignment with the first injection hole 25 of the injection plate 22 with respect to the axial direction of the valve assembly 20. The arm 37 may include a substantially rectangular shape while the end portion 39 may include a substantially similar perimeter shape to the first injection hole 25. For example, the end portion 39 may include an elongate stadium shape, elliptical shape, oval shape, rounded rectangular shape, or the like to ensure that the end portion 39 is capable of covering the first injection hole 25 when engaging the injection plate 22 around a periphery of the first injection hole 25.

The second reed 34 includes an arm 41 extending longitudinally between a pivot portion 42 and an end portion 43. The pivot portion 42 forms an axis about which the remainder of the second reed 34 (including the end portion 43 disposed at a distal end of the arm 41 opposite the pivot portion 42) flexes relative to the stationary connecting portion 35. The end portion 43 is disposed in alignment with the second injection hole 26 of the injection plate 22 with respect to the axial direction of the valve assembly 20. The arm 41 may include a substantially rectangular shape while the end portion 43 may include a substantially similar perimeter shape to the second injection hole 26. For example, the end portion 43 may include an elongate stadium shape, elliptical shape, oval shape, rounded rectangular shape, or the like to ensure that the end portion 43 is capable of covering the second injection hole 26 when engaging the injection plate 22 around a periphery of the second injection hole 26.

The double reed structure 30 further includes a pair of locating openings 48 disposed in outwardly disposed regions of the connecting portion 35 formed at opposing corners thereof. Each of the pair of the locating openings 48 is disposed in alignment with a corresponding one of the locating openings 28 of the injection plate 22. Each of the locating openings 48 is configured to receive a corresponding one of the locating features 118 therethrough when the valve assembly 20 is in the assembled configuration to properly position the double reed structure 30 relative to the injection plate 22 as well as the valve gasket 50.

The double reed structure 30 is formed from a resiliently flexible material allowing for each of the arms 37, 41 of the reeds 33, 34 to flex about the respective pivot portions 38, 42 away from the plane generally defined by the double reed structure 30. The resiliently flexible material is selected to allow for repeated elastic deformations of each of the reeds 33, 34 about the pivot portions 38, 42 while still allowing for each of the reeds 33, 34 to spring back to the original positions thereof wherein the reeds 33, 34 are arranged perpendicular to the axial direction of the valve assembly 20 and parallel to the major surfaces 31, 32 of the connecting portion 35 of the double reed structure 30. The flexing of each of the reeds 33, 34 away from the corresponding injection hole 25, 26 requires a force being applied to each of the reeds 33, 34 that overcomes a spring force generated by the resiliency of each of the reeds 33, 34 at each of the corresponding pivot portions 38, 42. The double reed structure 30 may accordingly be formed from a suitable metallic material such as aluminium, steel, or alloys thereof.

The valve gasket 50 includes a planar portion 51 having a thin and plat-like configuration with the planar portion 51 having a first major surface 53 and an oppositely arranged second major surface 54 (best shown in FIG. 6), each of which is arranged substantially perpendicular to the axial direction of the valve assembly 20. The first major surface 53 is configured to face towards and sealingly engage the second major surface 32 of the double reed structure 30 and the second major surface 54 is configured to face towards and sealingly engage a first major surface 81 of the valve body 80 (FIG. 6). More specifically, the first major surface 53 of the planar portion 51 is configured to sealingly engage the stationary and non-flexing connecting portion 35 of the double reed structure 30. The first major surface 53 further includes a bead 52 projecting axially from a periphery thereof with the bead 52 configured to sealingly engage the second major surface 24 of the injection plate 22 about a periphery thereof. The bead 52 engages the second major surface 24 peripherally to surround the injection holes 25, 26 and the locating openings 28 of the injection plate 22. The bead 52 projects from the remainder of the first major surface 53 a suitable axial distance to account for the thickness of the intervening double reed structure 30 when establishing the engagement with the injection plate 22.

The valve gasket 50 further includes a first flap 55 and a second flap 65, each of which extends from and is formed continuous with the planar portion 51 of the valve gasket 50. In other words, the planar portion 51, the first flap 55, and the second flap 65 are all formed integrally as part of a unitary and monolithic structure. The first flap 55 and the second flap 65 each extend away from the planar portion 51 in opposing and parallel directions. The first flap 55 is aligned with the first reed 33 with respect to the axial direction of the valve assembly 20 and the second flap 65 is aligned with the second reed 34 with respect to the axial direction of the valve assembly 20.

The first flap 55 includes a proximate end 56 connected to and continuous with the planar portion 51 and a freely disposed distal end 57. The first flap 55 further includes a contact surface 58 (FIG. 6) formed continuous with the first major surface 53 of the planar portion 51 with the contact surface 58 facing towards the first reed 33 of the double reed structure 30. The first flap 55, and more specifically the contact surface 58 thereof, is arranged at an incline relative to the plane of the planar portion 51 with the first flap 55 inclined away from the injection plate 22 and towards the valve body 80. The incline includes an axial distance present between the contact surface 58 and the connecting portion 35 of the double reed structure 30 progressively increasing as the first flap 55 extends from the proximate end 56 to the distal end 57. The contact surface 58 is configured to engage the first reed 33 when the first reed 33 is flexed or pivoted towards the contact surface 58 as a result of the pressure applied thereto by the refrigerant passing through the valve assembly 20. The contact surface 58 may include a substantially similar shape to the first reed 33 and may include a slightly larger size than the first reed 33 to ensure that the first reed 33 makes consistent contact with the contact surface 58 each time the first reed 33 is flexed towards the contact surface 58. The incline of the contact surface 58 may be substantially constant, but may also include a slight curvature to account for any curvature present in the first reed 33 as a result of the flexing thereof. The incline of the contact surface 58 may be at an angle of about 3-5 degrees relative to the plane of the planar portion 51, but other angles of inclination may be utilized while remaining within the scope of the present invention.

Figure 5:
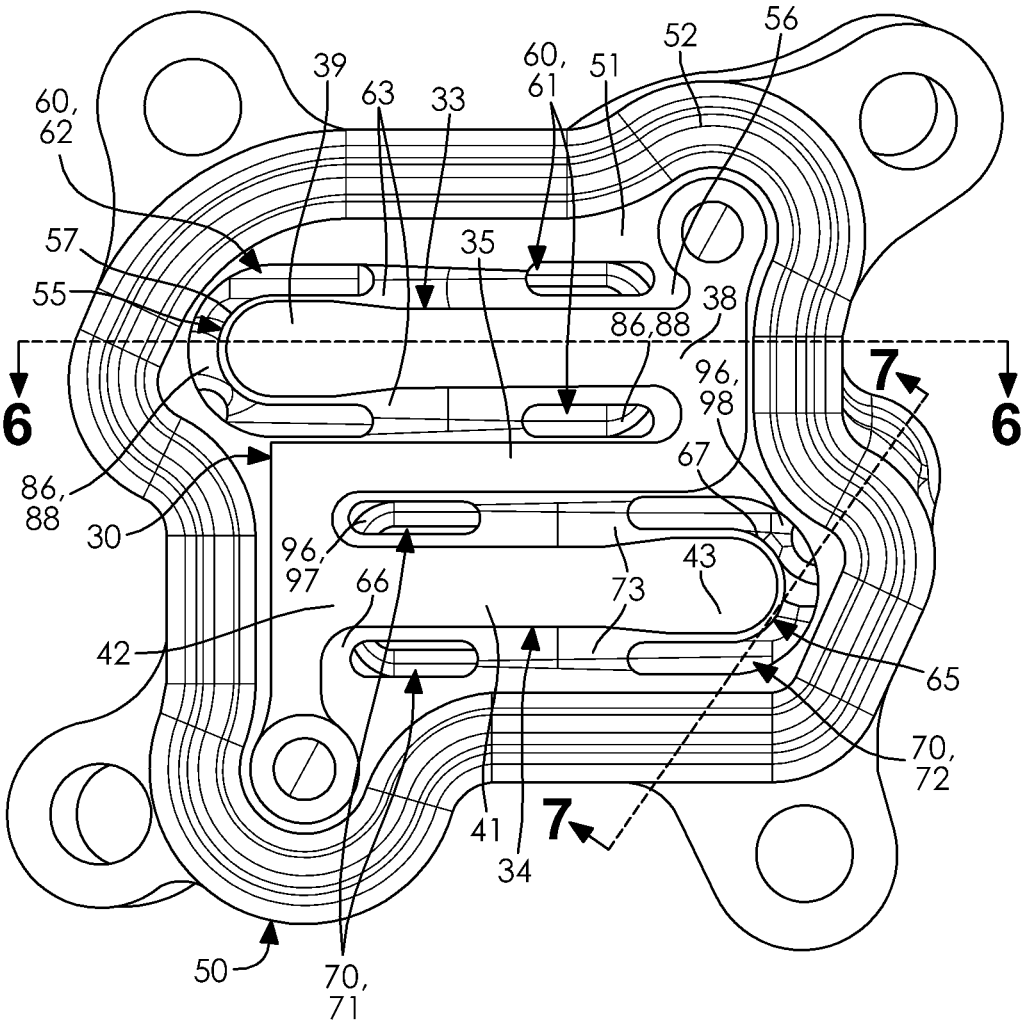
FIG. 5 is an axial end elevational view of the reed structure, the valve gasket, and the valve body shown in the absence of the injection plate.

As best shown in FIG. 5, the inclined deviation of the first flap 55 from the planar portion 51 includes the formation of a peripheral opening 60 around at least a portion of the perimeter of the first flap 55. The peripheral opening 60 is configured to allow for passage of the refrigerant through the valve gasket 50 when progressing towards the valve body 80. In the provided embodiment, the peripheral opening 60 is subdivided into a pair of proximate openings 61 adjacent the proximate end 56 and a distal opening 62 extending around the distal end 57, wherein the distal opening 62 is separated from the proximate openings 61 via a pair of opposing linking segments 63 connecting the planar portion 51 to the first flap 55 at opposing positions intermediate the proximate end 56 and the distal end 57 thereof. The linking segments 63 provide stiffness and stability to the first flap 55 to maintain the configuration of the first flap 55 when the first reed 33 flexes towards and engages the first flap 55.

The second flap 65 includes a proximate end 66 connected to and continuous with the planar portion 51 and a freely disposed distal end 67. The second flap 65 further includes a contact surface 68 formed continuous with the first major surface 53 of the planar portion 51 with the contact surface 58 facing towards the second reed 34 of the double reed structure 30. The second flap 65, and more specifically the contact surface 68 thereof, is arranged at an incline relative to the plane of the planar portion 51 with the second flap 65 inclined away from the injection plate 22 and towards the valve body 80. The incline includes an axial distance present between the contact surface 68 and the connecting portion 35 of the double reed structure 30 progressively increasing as the second flap 65 extends from the proximate end 66 to the distal end 67. The contact surface 68 is configured to engage the second reed 34 when the second reed 34 is flexed or pivoted towards the contact surface 68 as a result of the pressure force applied thereto by the refrigerant passing through the valve assembly 20. The contact surface 68 may include a substantially similar shape to the second reed 34 and may include a slightly larger size than the second reed 34 to ensure that the second reed 34 makes consistent contact with the contact surface 68 each time the second reed 34 is flexed towards the contact surface 68. The incline of the contact surface 68 may be substantially constant, but may also include a slight curvature to account for any curvature present in the second reed 34 as a result of the flexing thereof. The incline of the contact surface 68 may be at an angle of about 3-5 degrees relative to the plane of the planar portion 51, but other angles of inclination may be utilized while remaining within the scope of the present invention.

The inclined deviation of the second flap 65 from the planar portion 51 includes the formation of a peripheral opening 70 around at least a portion of the perimeter of the second flap 65. The peripheral opening 70 is configured to allow for passage of the refrigerant through the valve gasket 50 when progressing towards the valve body 80. In the provided embodiment, the peripheral opening 70 is subdivided into a pair of proximate openings 71 adjacent the proximate end 66 and a distal opening 72 extending around the distal end 67, wherein the distal opening 72 is separated from the proximate openings 71 via a pair of opposing linking segments 73 connecting the planar portion 51 to the second flap 65 at opposing positions intermediate the proximate end 66 and the distal end 67 thereof. The linking segments 73 provide stiffness and stability to the second flap 65 to maintain the configuration of the second flap 65 when the second reed 34 flexes towards and engages the second flap 65.

The valve gasket 50 includes four fastener openings 77 formed therethrough at positions exterior to the bead 52. Each of the four fastener openings 77 is disposed in alignment with a corresponding one of the fastener openings 27 of the injection plate 22 and is configured to receive a corresponding one of the threaded fasteners 117 therethrough. The valve gasket 50 further includes a pair of locating openings 78 formed therethrough at positions interior to the bead 52. Each of the pair of the locating openings 78 is disposed in alignment with a corresponding one of the locating openings 48 of the double reed structure 30 and is configured to receive a corresponding one of the locating features 118 therethrough.

The entirety of the valve gasket 50 (including the planar portion 51, the bead 52, the first flap 55, and the second flap 65) is formed from a resiliently compressible material suitable for sealingly engaging each of the corresponding surfaces of the injection plate 22, the double reed structure 30, and the valve body 80 as described above. The valve gasket 50 may be formed (molded) from a polymeric material such as an elastomer, as desired. The use of the elastomeric material in forming the valve gasket 50 prevents repeated metal-to-metal contact with the reeds 33, 34 during operation of the scroll compressor 1, which increases a durability of the double reed structure 30 due to the relative softness of the elastomeric material in comparison to a stiff metallic material.

The valve body 80 includes a periphery of the first major surface 81 thereof configured to engage a periphery of the second major surface 54 of the planar portion 51. The periphery of the first major surface 81 is arranged perpendicular to the axial direction of the valve assembly 20. A second major surface 82 of the valve body 80 formed opposite the first major surface 81 faces towards the outer face 16 of the fixed scroll 5. The first major surface 81 includes a first indentation 85 (FIG. 6) and a spaced apart second indentation 95 (FIG. 7) formed therein with the indentations 85, 95 extending longitudinally in parallel to each other in a staggered configuration.

The first indentation 85 is disposed in alignment with the first flap 55 with respect to the axial direction of the valve assembly 20 with at least a portion of the inclined first flap 55 extending into the first indentation 85. The first indentation 85 is defined by a surface 86 inclined at an angle relative to the plane of the periphery of the first major surface 81. The surface 86 extends from a proximate end 87 disposed adjacent the proximate end 56 of the first flap 55 to a distal end 88 disposed adjacent the distal end 57 of the first flap 55. An axial depth of the first indentation 85 increases as the surface 86 progresses from the proximate end 87 to the distal end 88 thereof to cause the distal end 88 to have a maximized depth towards the fixed scroll 5. The angle of inclination of the surface 86 may substantially correspond to the angle of inclination of the first flap 55, such as being inclined at about 3-5 degrees, but alternative configurations may be utilized without necessarily departing from the scope of the present invention.

The extension of the first flap 55 into the first indentation 85 divides the first indentation 85 into a first flow space 89 between the first flap 55 and the plane defined by the periphery of the first major surface 81 and a second flow space 91 between the first flap 55 and the inclined portion of the surface 86. Any refrigerant present within the first flow space 89 is able to flow through the valve gasket 50 to the second flow space 91 by flowing through the peripheral opening 60 surrounding the first flap 55.

The second major surface 82 of the valve body 80 includes a first post 83 projecting axially therefrom and towards the fixed scroll 5. A first flow passageway 92 is formed through the valve body 80 and extends from the first indentation 85 to an axial end of the first post 83 engaging the fixed scroll 5 around a periphery of the first injection port 17. The first flow passageway 92 provides fluid communication between the first indentation 85 and the first injection port 17 of the fixed scroll 5. An O-ring or similar sealing element (not shown) may be disposed between an end portion of the first post 83 and the outer face 16 of the fixed scroll 5 or a surface defining the first injection port 17 to fluidly seal the joint therebetween. The first flow passageway 92 may extend from the distal end 88 of the surface 86 defining the first indentation 85 at a position offset from the distal end 57 of the first flap 55 with respect to a direction perpendicular to the axial direction of the valve assembly 20. The offset may be present to prevent too great of a change of direction of the refrigerant when flowing from the distal end 57 of the first flap 55 towards the first flow passageway 92. The first indentation 85 and the first flow passageway 92 accordingly cooperate to form a first flow path through the valve body 80 configured for fluid communication with the first injection port 17.

Figure 7:
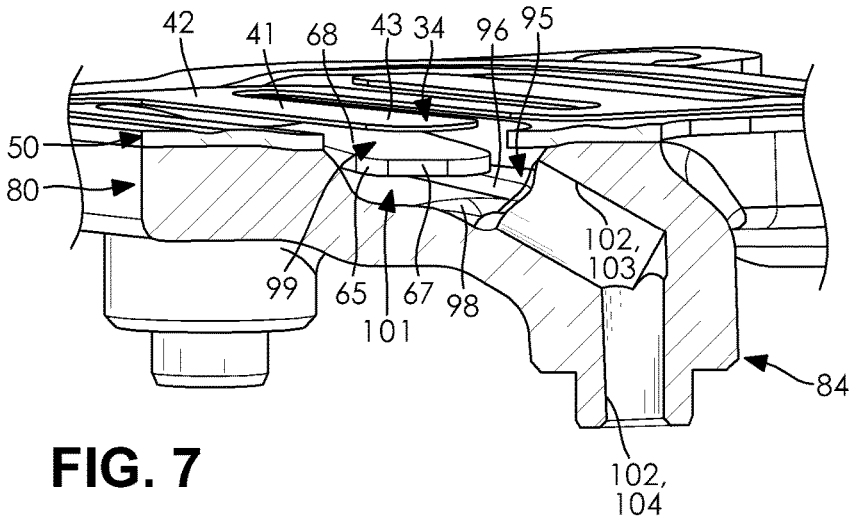
FIG. 7 is a fragmentary cross-sectional perspective view of the reed structure, the valve gasket, and the valve body as taken from the perspective of section lines 7-7 in FIG. 5.
Figure 8:
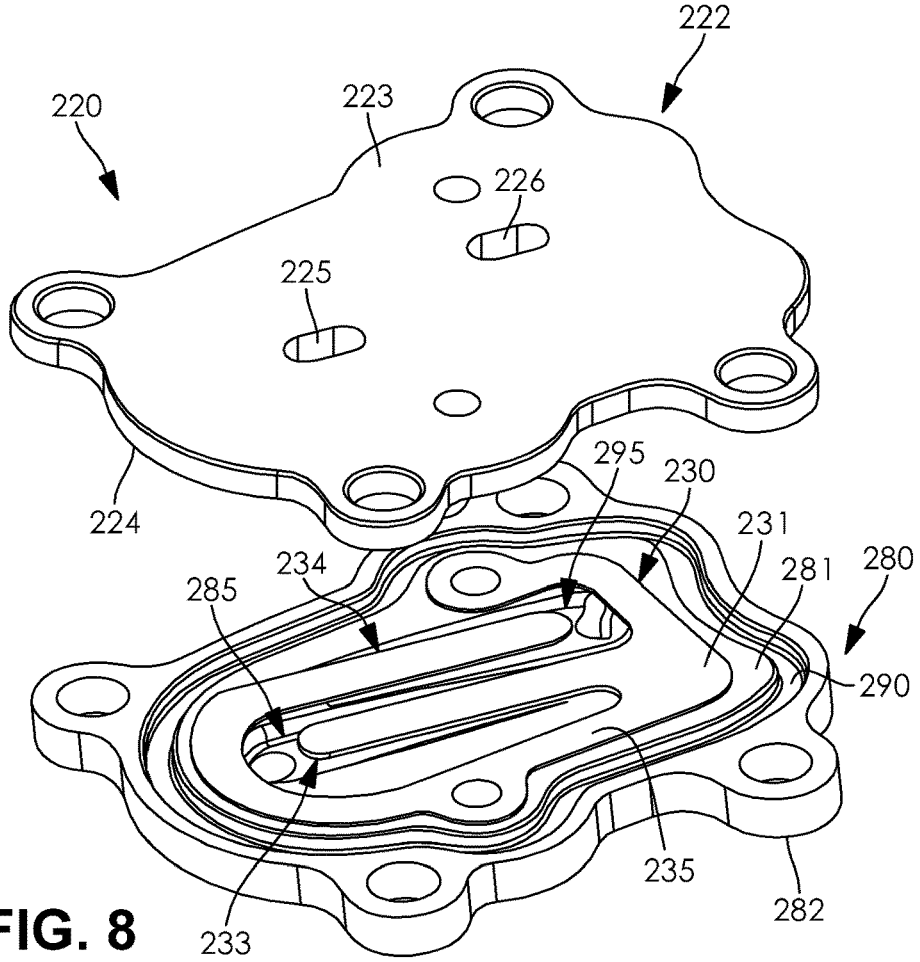
FIG. 8 is a partially exploded perspective view of an injection valve assembly according to another embodiment of the present invention with an injection plate thereof separated from a reed structure and a valve body thereof.
Figure 9:
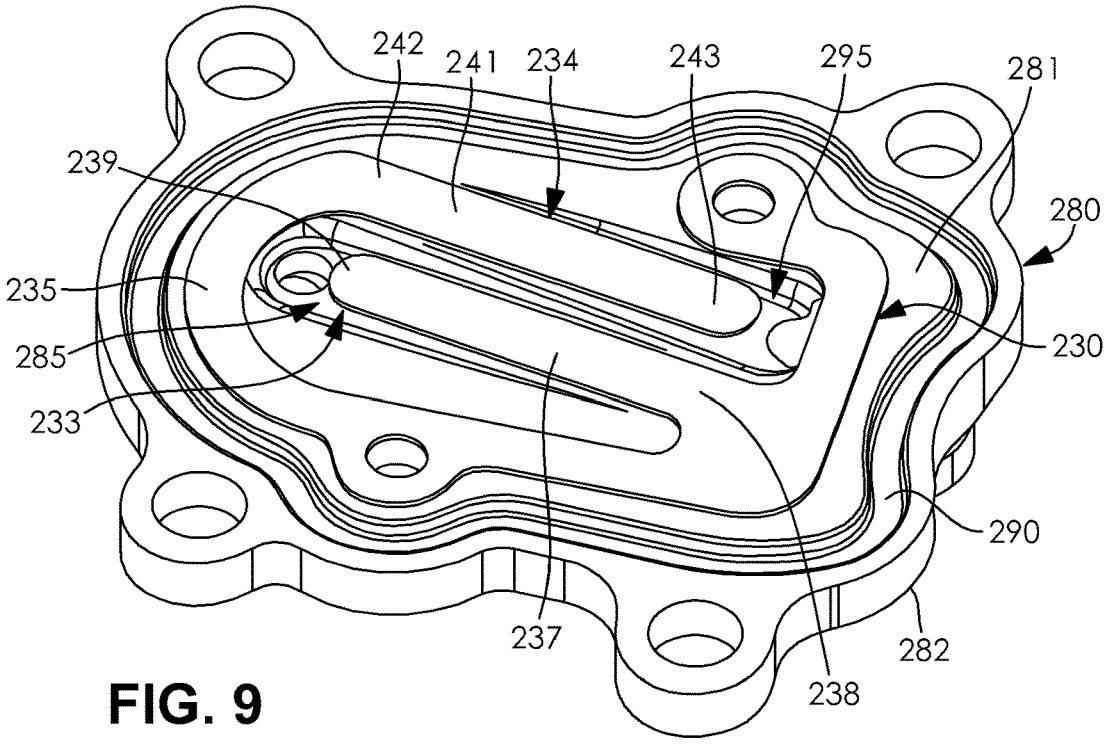
FIG. 9 is a perspective view of the reed structure and the valve body of the injection valve assembly of FIG. 8.
Figure 10:
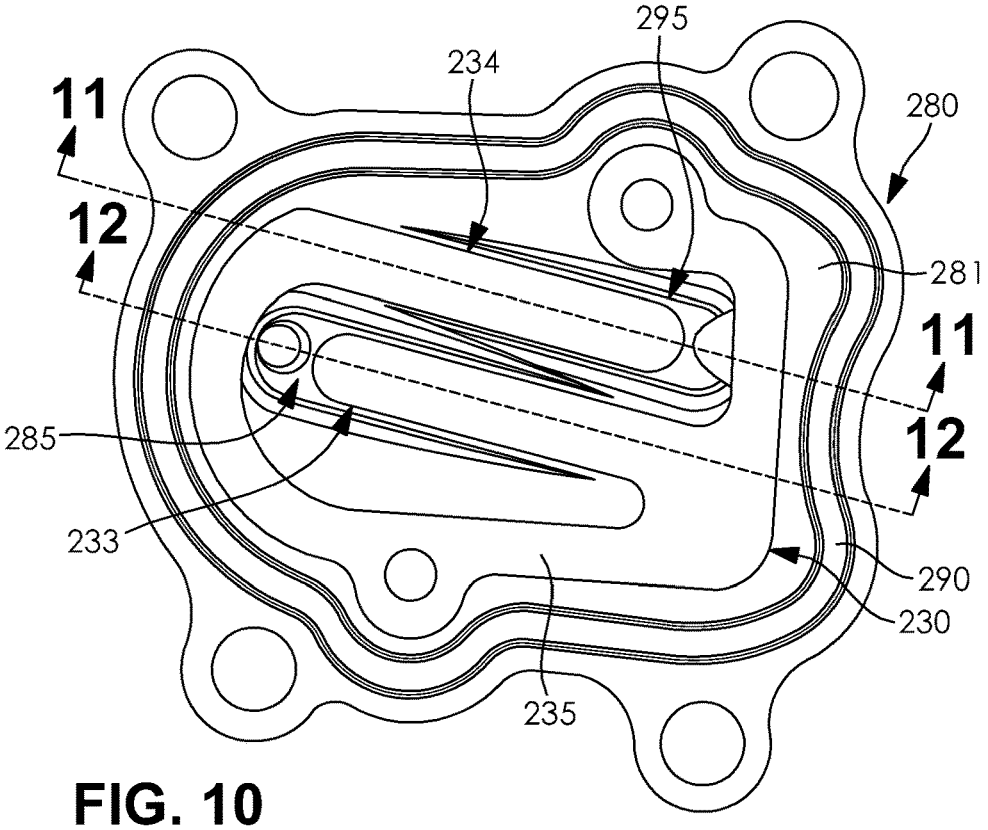
FIG. 10 is an axial end elevational view of the reed structure and the valve body of the injection valve assembly of FIG. 8.
Figure 11:
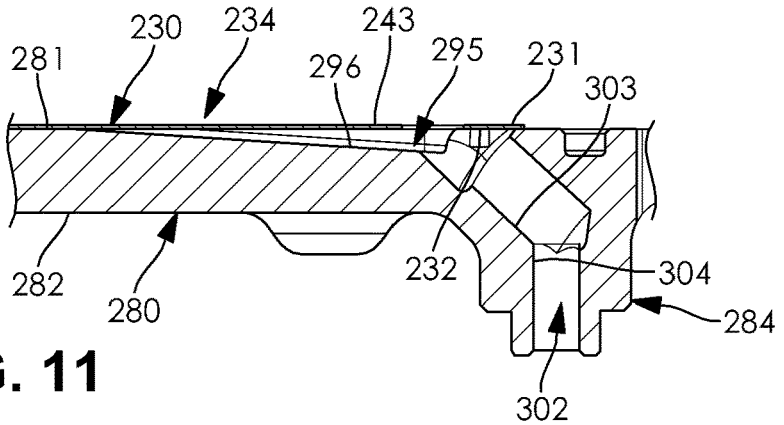
FIG. 11 is a fragmentary cross-sectional perspective view of the reed structure and the valve body as taken from the perspective of section lines 11-11 in FIG. 10.
Figure 12:
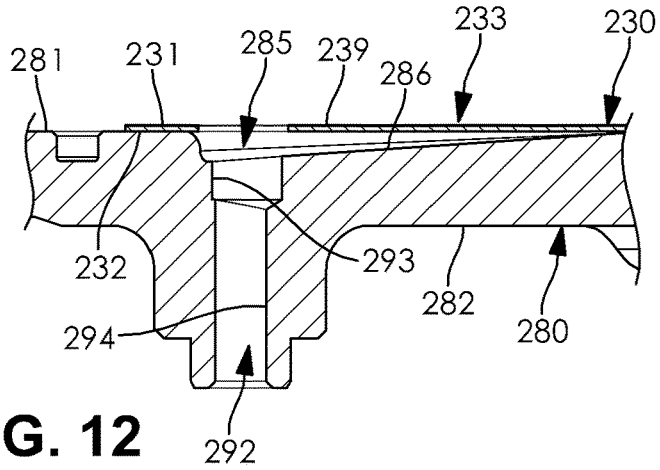
FIG. 12 is a fragmentary cross-sectional perspective view of the reed structure and the valve body as taken from the perspective of section lines 12-12 in FIG. 10.

The first flow passageway 92 is formed from a first segment 93 extending from the surface 86 of the first indentation 85 and a second segment 94 (shown in phantom lines in FIG. 6) extending to the end of the first post 83. The configuration of the first flow passageway 92 may be best understood by review of a second flow passageway 102 associated with the second indentation 95 as shown in FIG. 7, due to each of the flow paths 92, 102 having substantially identical configurations. The first segment 93 and the second segment 94 are each shown as having a substantially cylindrical shape for forming a substantially circular cross-sectional flow area through each of the segments 93, 94, but alternative configurations may be utilized without necessarily departing from the scope of the present invention. The first segment 93 includes a first diameter that is greater than a second diameter of the second segment 94, thus the first segment 93 includes a greater cross-sectional flow area than the second segment 94. The first segment 93 having a larger cross-sectional area than the second segment 94 reduces a pressure drop experienced by the refrigerant when flowing through the first flow passageway 92 to minimize flow losses during operation of the valve assembly 20. Additionally, the cross-sectional flow area through the first indentation 85 immediately upstream of the first flow passageway 92 is also greater than that of the first segment 93 thereof, thereby further ensuring the absence of the pressure drop and flow loss.

The first segment 93 and the second segment 94 may be disposed at an angle relative to each other. In the illustrated embodiment, the first segment 93 is inclined relative to the axial direction of the valve assembly 20 while the second segment 94 is axially aligned with the first injection port 17 and arranged parallel to the axial direction of the valve assembly 20.

The second indentation 95 is disposed in alignment with the second flap 65 with respect to the axial direction of the valve assembly 20 with at least a portion of the inclined second flap 65 extending into the second indentation 95. The second indentation 95 is defined by a surface 96 inclined at an angle relative to the plane of the periphery of the first major surface 81. The surface 96 extends from a proximate end 97 disposed adjacent the proximate end 66 of the second flap 65 to a distal end 98 disposed adjacent the distal end 67 of the second flap 65. An axial depth of the second indentation 95 increases as the surface 96 progresses from the proximate end 97 to the distal end 98 thereof to cause the distal end 98 to have a maximized depth towards the fixed scroll 5. The angle of inclination of the surface 96 may substantially correspond to the angle of inclination of the second flap 65, such as being inclined at about 3-5 degrees, but alternative configurations may be utilized without necessarily departing from the scope of the present invention.

The extension of the second flap 65 into the second indentation 95 divides the second indentation 95 into a first flow space 99 between the second flap 65 and the plane defined by the periphery of the first major surface 81 and a second flow space 101 between the second flap 65 and the inclined portion of the surface 96. Any refrigerant present within the first flow space 99 is able to flow through the valve gasket 50 to the second flow space 101 by flowing through the peripheral opening 70 surrounding the second flap 65.

The second major surface 82 of the valve body 80 includes a second post 84 projecting axially therefrom and towards the fixed scroll 5. The second flow passageway 102 is formed through the valve body 80 and extends from the second indentation 95 to an axial end of the second post 84 engaging the fixed scroll 5 around a periphery of the second injection port 18. The second flow passageway 102 provides fluid communication between the second indentation 95 and the second injection port 18 of the fixed scroll 5. An O-ring or similar sealing element (not shown) may be disposed between the end portion of the second post 84 and the outer face 16 of the fixed scroll 5 or a surface of the second injection port 18 to fluidly seal the joint therebetween. The second flow passageway 102 may extend from the distal end 98 of the surface 96 defining the second indentation 95 at a position offset from the distal end 67 of the second flap 65 with respect to a direction perpendicular to the axial direction of the valve assembly 20. The offset may be present to prevent too great of a change of direction of the refrigerant when flowing from the distal end 67 of the second flap 65 towards the second flow passageway 102. The second indentation 95 and the second flow passageway 102 accordingly cooperate to form a second flow path through the valve body 80 configured for fluid communication with the second injection port 18.

The second flow passageway 102 is formed from a first segment 103 extending from the surface 96 of the second indentation 95 and a second segment 104 extending to the end of the second post 84. The first segment 103 and the second segment 104 are each shown as having a substantially cylindrical shape for forming a substantially circular cross-sectional flow area through each of the segments 103, 104, but alternative configurations may be utilized without necessarily departing from the scope of the present invention. The first segment 103 includes a first diameter that is greater than a second diameter of the second segment 104, thus the first segment 103 includes a greater cross-sectional flow area than the second segment 104. The first segment 103 having a larger cross-sectional area than the second segment 104 reduces a pressure drop experienced by the refrigerant when flowing through the second flow passageway 102 to minimize flow losses during operation of the valve assembly 20. Additionally, the cross-sectional flow area through the second indentation 95 immediately upstream of the second flow passageway 102 is also greater than that of the first segment 103 thereof, thereby further ensuring the absence of the pressure drop and flow loss.

The first segment 103 and the second segment 104 may be disposed at an angle relative to each other. In the illustrated embodiment, the first segment 103 is inclined relative to the axial direction of the valve assembly 20 while the second segment 104 is axially aligned with the second injection port 18 and arranged parallel to the axial direction of the valve assembly 20.

The valve body 80 includes four fastener openings 107 formed therethrough about a periphery thereof with each of the four fastener openings 107 disposed in alignment with a corresponding one of the fastener openings 77 of the valve gasket 50 and configured to receive a corresponding one of the threaded fasteners 117 therethrough. The valve body 80 further includes a pair of locating openings 108 formed therethrough with each of the pair of the locating openings 108 disposed in alignment with a corresponding one of the locating openings 78 of the valve gasket 50 and configured to receive a corresponding one of the locating features 118 therethrough.

The valve body 80 is formed from a rigid material resistant to deformation when subjected to the pressure applied by the refrigerant passing through the valve assembly 20. The valve body 80 may be formed from a metallic material such as aluminum, aluminum alloy, steel, or the like, as desired.

Operation of the valve assembly 20 is now described. Because the flow configuration of the refrigerant is substantially identical with respect to each of the partial refrigerant flows entering each of the injection ports 17, 18, only the partial refrigerant flow passing from the first injection hole 25 to the first injection port 17 is described in detail hereinafter with the understanding that the corresponding and analogous components associated with the other partial refrigerant flow passing from the second injection hole 26 to the second injection port 18 operate in the same manner.

During operation of the scroll compressor 1, at least a portion of the refrigerant discharged from the compression mechanism formed by the cooperating scrolls 5, 7 is returned back to the injection chamber 113 via the refrigerant return passage 112. The end portion 39 of the first reed 33 is configured to normally extend across and cover the first injection hole 25 to prevent undesired flow of the returned refrigerant from the injection chamber 3 and towards the first injection port 17. The compression mechanism of the scroll compressor 1 operates to cause the first injection port 17 to repeatedly experience a variable pressure of the refrigerant within the compression mechanism depending on the progression of each subsequent compression chamber 9 passing by the first injection port 17.

When the variable pressure experienced by the first injection port 17 from the refrigerant originating from within the compression mechanism is relatively high, the end portion 39 of the first reed 33 is maintained against the surface of the injection plate 22 surrounding the first injection hole 25 to continue to prevent the passage of the refrigerant within the injection chamber 113 towards the first injection port 17. However, when the variable pressure experienced by the first injection port 17 from the refrigerant originating from within the compression mechanism is relatively low, the pressure of the refrigerant within the injection chamber 113 eventually exceeds the relatively low pressure originating from the compression mechanism and a pressure differential is established across the opposing surfaces of the end portion 39 of the first reed 33. When the force of the pressure of the refrigerant within the injection chamber 113 exceeds the combined force of the pressure of the refrigerant originating from the compression mechanism and a spring force generated by a resiliency of the first reed 33 at the pivot portion 38 thereof, the first reed 33 pivots about the axis defined by the pivot portion 38 and towards the valve body 80. The pivoting of the first reed 33 causes the refrigerant within the injection chamber 113 to pass through the first injection hole 25 and around the now axially spaced end portion 39 of the first reed 33. The first reed 33 may pivot until encountering the contact surface 58 of the first flap 55 of the valve gasket 50, which provides a relatively soft stop limiting the rotation of the first reed 33.

The refrigerant originating from the injection chamber 113 then proceeds through the open space formed by the first indentation 85 of the valve body 80 while passing through the valve gasket 50 via the peripheral opening 60 surrounding the first flap 55. The refrigerant then flows towards and passes through the first flow passageway 92 and into the first injection port 17. The refrigerant is then injected into the corresponding compression chamber 9 while having a higher pressure than the refrigerant already disposed within the compression chamber 9 and originating from one of the inlet openings 11 of the fixed scroll 5, which allows for the compression capacity of the scroll compressor 1 to be increased by reintroducing higher pressure refrigerant into the compression mechanism at an intermediate position of the compression process.

The first reed 33 eventually resiliently springs back to the position blocking flow from the injection chamber 113 through the valve assembly 20 based on the cycling of the compression mechanism and the resulting pressure differential on the opposing sides of the first reed 33. The valve assembly 20 accordingly acts a check valve for preventing a flow of the refrigerant in an undesired direction relative to the first reed 33, which in turn prevents the refrigerant originating from the compression mechanism backflowing into the injection chamber 113 in an undesired flow direction. The described process is repeatedly performed as the pressure experienced by the first injection port 17 is varied with respect to each passing compression chamber 9 formed by the orbiting of the orbiting scroll 7 relative to the fixed scroll 5.

The valve assembly 20 as shown and described offers numerous advantageous features. As is apparent from a review of FIGS. 3-5, a first half of the valve assembly 20 having the components associated with the partial flow towards the first injection port 17 and a second half of the valve assembly 20 having the components associated with the partial flow towards the second injection port 18 are substantially structurally identical with the second half rotated 180 degrees relative to the first half with respect to a central axis passing through the valve assembly 20, wherein the central axis substantially corresponds to the position of the discharge opening 13 of the fixed scroll 5 and the position at which the refrigerant return passageway 112 intersects the injection chamber 113. This staggered and 180 degree rotated relationship between the two partial flows results in a more even distribution of the refrigerant to each of the injection ports 17, 18 as each of the partial flows experiences substantially similar flow conditions and flow path lengths. The elongation of each of the injection holes 25, 26 allows for a greater pressure force to be applied to each of the reeds 33, 34 for selectively actuating the reeds 33, 34. The unitary formation of the double reed structure 30 simplifies the manufacturing of the valve assembly 20. The inclined flaps 55, 65 of the valve gasket 50 provide soft contact surfaces 58, 68 for preventing metal-to-metal contact with the reeds 33, 34 during repeated flexing of the reeds 33, 34. This soft contact increases the durability of the reeds 33, 34 and prevents the generation of NVH that could be experienced within the passenger compartment of the vehicle. The inclined configuration of the flaps 55, 65 also prescribed the degree of flex experienced by each of the reeds 33, 34, which further improves the durability of the reeds 33, 34 at the respective pivot portions 38, 42 thereof. The progressively decreasing flow area through each of the flows paths formed through the valve body 80 prevents an undesired pressure drop or flow loss for the refrigerant when flowing towards the respective injection ports 17, 18.

Referring now to FIGS. 8-12, a valve assembly 220 according to another embodiment of the present invention is disclosed. The valve assembly 220 is similar to the valve assembly 20 is many respects, and includes an injection plate 222, a double reed structure 230, and valve body 280, each of which may be formed from the same materials described as being suitable for use in forming the corresponding components of the valve assembly 20. The components forming the valve assembly 220 include similarly positioned locating openings and fastener openings for positioning the valve assembly 220 between the fixed scroll 5 and the rear housing 110 as described with reference to the valve assembly 20, hence further description of these features and a method of assembly of the valve assembly 220 are omitted herefrom. However, the valve assembly 220 differs from the valve assembly 20 in that a valve gasket (not shown) of the valve assembly 220 is used only to form a peripheral seal between the injection plate 222 and the valve body 280 for preventing the lateral escape of the refrigerant passing through the valve assembly 220, and is not disposed between the double reed structure 230 and the valve body 280 for providing a contact surface for the double reed structure 230 to engage during a flexing thereof as described hereinabove.

The injection plate 222 includes a substantially planar first major surface 223 and an oppositely arranged and also substantially planar second major surface 224. The injection plate 222 includes a first injection hole 225 and a spaced apart second injection hole 226 extending through the injection plate 222 with respect to the axial direction from the first major surface 223 to the second major surface 224 thereof, wherein each of the injections holes 225, 226 is positioned and shaped in similar fashion to the injections holes 25, 26 of the valve assembly 20.

The double reed structure 230 is a thin and planar plate-like body including a first major surface 231 and an oppositely arranged second major surface 232. The double reed structure 230 includes a first reed 233, a second reed 234, and a connecting portion 235, with the reeds 233, 234 and the connecting portion 235 once again integrally formed as one monolithic structure. The first reed 233 includes an arm 237 extending longitudinally between a pivot portion 238 and an end portion 239 while the second reed 234 includes an arm 241 extending longitudinally between a pivot portion 242 and an end portion 243. The reeds 233, 234 once again pivot about the corresponding pivot portions 238, 242 with the corresponding end portions 239, 243 configured to selectively cover each of the corresponding injection holes 225, 226. The arms 237, 241 and the end portions 239, 243 include substantially similar shapes and configurations as the arms 37, 41 and the end portions 39, 43 of the double reed structure 30 of the valve assembly 20. The connecting portion 235 differs from the connecting portion 35 of the valve assembly 20 in that the connecting portion 235 extends around a periphery of the double reed structure 230 when connecting the pivot portions 238, 242 rather than extending across a central portion of the double reed structure 230.

The valve body 280 includes a first major surface 281 thereof configured to engage the connecting portion 235 of the double reed structure 230 and an oppositely arranged second major surface 282 configured to face towards the outer face 16 of the fixed scroll 5. The first major surface 81 includes a first indentation 285 corresponding to the first reed 233 and a spaced apart second indentation 295 corresponding to the second reed 234. The first indentation 285 is defined by a surface 286 inclined at an angle relative to the plane of the periphery of the first major surface 281 with an axial depth of the first indentation 285 increasing as the surface 286 progresses towards the end portion 239 of the first reed 233. The second indentation 295 is defined by a surface 296 inclined at an angle relative to the plane of the periphery of the first major surface 281 with an axial depth of the second indentation 295 increasing as the surface 296 progresses towards the end portion 243 of the second reed 234.

The second major surface 282 of the valve body 280 includes a first post 283 projecting axially therefrom and towards the fixed scroll 5. A first flow passageway 292 is formed through the valve body 280 and extends from a deep end of the first indentation 285 to an axial end of the first post 283 engaging the fixed scroll 5 around a periphery of the first injection port 17. The first flow passageway 292 is formed from a first segment 293 extending from the surface 286 of the first indentation 285 and a second segment 294 extending to the end of the first post 283. The first segment 293 includes a first diameter that is greater than a second diameter of the second segment 294, thus the first segment 293 includes a greater cross-sectional flow area than the second segment 294. The first segment 293 and the second segment 294 may be disposed at an angle relative to each other. In the illustrated embodiment, the first segment 293 is inclined relative to the axial direction of the valve assembly 220 while the second segment 294 is axially aligned with the first injection port 17 and arranged parallel to the axial direction of the valve assembly 220.

The second major surface 282 of the valve body 280 includes a second post 284 projecting axially therefrom and towards the fixed scroll 5. A second flow passageway 302 is formed through the valve body 280 and extends from a deep end of the second indentation 295 to an axial end of the second post 284 engaging the fixed scroll 5 around a periphery of the second injection port 18. The second flow passageway 302 is formed from a first segment 303 extending from the surface 296 of the second indentation 295 and a second segment 304 extending to the end of the second post 284. The first segment 303 includes a first diameter that is greater than a second diameter of the second segment 304, thus the first segment 303 includes a greater cross-sectional flow area than the second segment 304. In contrast to the first flow passageway 292, the second flow passageway 302 includes the first segment 303 and the second segment 304 arranged in parallel and axially aligned with the second injection port 18.

The first major surface 281 of the valve body 280 includes a peripherally disposed gasket groove 290 formed therein configured to receive a gasket therein. As mentioned above, the gasket disposed between the valve body 280 and the injection plate 222 does not extend to a position for interacting with the operation of the double reed structure 230. Instead, the double reed structure 230 is sandwiched between the planar portions of the first major surface 281 and the second major surface 224 of the injection plate 222.

The valve assembly 220 operates in substantially the same manner as the valve assembly 20. The reeds 233, 234 normally engage the injection plate 222 at positions covering the corresponding injection holes 225, 226 until a pressure originating from the injection chamber 113 overcomes a pressure present in the respective injection ports 17, 18 as well as the spring force formed by each of the reeds 233, 234. The force imbalance causes each of the reeds 233, 234 to selectively flex away from the injection plate 222 to allow for fluid communication to occur between the injection chamber 113 and each of the respective indentations 285, 295. Each of the reeds 233, 234 flexes towards the respective surfaces 286, 296 defining the respective indentations 285, 295 and refrigerant flows through the respective injection holes 225, 226, the respective indentations 285, 295, and the respective flow passageways 292, 302 to provide fluid communication between the injection chamber 113 and each of the respective injection ports 17, 18.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A valve assembly for a scroll compressor including a fixed scroll having a first injection port and a second injection port fluidly coupled to a compression mechanism of the scroll compressor, the valve assembly comprising:

a valve body having a first flow path and a second flow path formed therethrough, the first flow path fluidly coupled to the first injection port and the second flow path fluidly coupled to the second injection port;

an injection plate having a first injection hole and a second injection hole formed therethrough; and a reed structure disposed between the injection plate and the valve body, the reed structure including a first reed configured to selectively permit a fluid to flow through the first injection hole towards the first flow path for entry into the compression mechanism through the first injection port and a second reed configured to selectively permit the fluid to flow through the second injection hole towards the second flow path for entry into the compression mechanism through the second injection port, wherein the first flow path is formed independently of the second flow path.

2. The valve assembly of claim 1, wherein the first injection hole and the second injection hole are each fluidly coupled to an injection chamber formed in the scroll compressor.

3. The valve assembly of claim 1, wherein the first reed and the second reed are arranged in a staggered configuration.

4. The valve assembly of claim 3, wherein the first reed extends longitudinally in a first direction from a pivot portion thereof to an end portion thereof, and wherein the second reed extends longitudinally in a second direction from a pivot portion thereof to an end portion thereof, wherein the first direction is arranged opposite the second direction.

5. The valve assembly of claim 1, wherein the reed structure includes a connecting portion connecting the first reed to the second reed, wherein the first reed, the second reed, and the connecting portion are formed as a unitary structure.

6. The valve assembly of claim 1, further including a valve gasket disposed between the reed structure and the valve body, the valve gasket including a first flap configured to contact the first reed when the first reed selectively permits the fluid to flow through the first injection hole towards the first flow path.

7. The valve assembly of claim 6, wherein the first reed is formed from a metallic material and the first flap is formed from an elastomeric material.

8. The valve assembly of claim 6, wherein the first flap is inclined relative to a plane of the injection plate.

9. The valve assembly of claim 8, wherein the first reed is configured to pivot away from the injection plate when the first reed selectively permits the fluid to flow through the first injection hole towards the first flow path, and wherein the first flap forms a stop surface for limiting the pivoting of the first reed away from the injection plate.

10. The valve assembly of claim 8, wherein the first flap extends at least partially into the first flow path formed in the valve body.

11. The valve assembly of claim 6, wherein a peripheral opening extends around at least a portion of a periphery of the first flap.

12. The valve assembly of claim 1, wherein the first flow path formed through the valve body includes a first indentation indented into the valve body and a first flow passageway extending from the first indentation through the valve body.

13. The valve assembly of claim 12, wherein the first reed pivots into the first indentation when the first reed selectively permits the fluid to flow through the first injection hole towards the first flow path.

14. The valve assembly of claim 12, wherein the first flow passageway includes a first segment extending from the first indentation and a second segment extending from the first segment, the first segment having a first cross-sectional flow area and the second segment having a second cross-sectional flow area, wherein the first cross-sectional flow area is greater than the second cross-sectional flow area.

15. The valve assembly of claim 1, wherein the first injection hole is elongated in a longitudinal direction of the first reed.

16. A valve assembly for a scroll compressor including a fixed scroll having a pair of injection ports fluidly coupled to a compression mechanism of the scroll compressor, the valve assembly comprising:

a valve body having a pair of flow paths formed therethrough, each of the flow paths fluidly coupled to a corresponding one of the injection ports;

an injection plate having a pair of injection holes formed therethrough;

a reed structure disposed between the injection plate and the valve body, the reed structure including a pair of reeds with each of the reeds configured to selectively provide fluid communication between a corresponding one of the injection holes and a corresponding one of the injection ports; and a valve gasket disposed between the reed structure and the valve body, the valve gasket including a pair of flaps with each of the flaps configured to selectively contact a corresponding one of the reeds, wherein the pair of flow paths are formed independently of each other.

17. The valve assembly of claim 16, wherein the valve assembly is divided into a first half and a second half, the first half having substantially identical structure to the second half.

18. The valve assembly of claim 17, wherein the second half is rotated 180 degrees relative to the first half with respect to a central axis of the valve assembly.

19. A vapor injection scroll compressor comprising:

a compression mechanism formed by the cooperation of a fixed scroll and an orbiting scroll, the compression mechanism configured to compress a fluid therein, the fixed scroll including a pair of injection ports formed therethrough with each of the injection ports in fluid communication with the compression mechanism;

an injection chamber configured to receive a portion of the fluid after being compressed within the compression mechanism; and a valve assembly including:

a valve body having a pair of flow paths formed therethrough, each of the flow paths fluidly coupled to a corresponding one of the injection ports;

an injection plate having a pair of injection holes formed therethrough; and a reed structure disposed between the injection plate and the valve body, the reed structure having a pair of reeds, each of the reeds configured to selectively provide fluid communication between the injection chamber and a corresponding one of the injection ports, wherein the pair of flow paths are formed independently of each other.

* * * * *